United States Patent [19]

Kyoshima

[11] Patent Number: 4,947,194

[45] Date of Patent: Aug. 7, 1990

[54] LIQUID INJECTION RECORDING APPARATUS HAVING TEMPERATURE DETECTING MEANS IN A LIQUID PASSAGE

[75] Inventor: Masayuki Kyoshima, Hiratsuka, Japan

[73] Assignee: Canon Kabushiki Kaisha, Tokyo, Japan

[21] Appl. No.: 394,267

[22] Filed: Aug. 11, 1989

Related U.S. Application Data

[63] Continuation of Ser. No. 117,526, Nov. 6, 1987, abandoned.

[30] Foreign Application Priority Data

Nov. 6, 1986 [JP] Japan ..... 61-264997

[51] Int. Cl.[5] ..... B41J 2/05; B41J 2/195

[52] U.S. Cl. ..... 346/140 R

[58] Field of Search ..... 346/140

[56] References Cited

U.S. PATENT DOCUMENTS 4,250,512 2/1981 Kattner et al. ..... 346/140 R
4,352,114 9/1982 Kyoguku et al. ..... 346/140 R
4,376,945 3/1983 Hara ..... 346/140
4,544,931 10/1985 Watanabe et al. ..... 346/140 R
4,550,327 10/1985 Miyakawa ..... 346/140 R
4,587,534 5/1986 Saito ..... 346/140
4,660,056 4/1987 Yokoi ..... 346/140 R
4,719,472 1/1988 Arakawa ..... 346/140

FOREIGN PATENT DOCUMENTS 47666 3/1982 Japan .

*Primary Examiner*—Joseph W. Hartary
*Attorney, Agent, or Firm*—Fitzpatrick, Cella, Harper & Scinto

[57] ABSTRACT

A liquid injection recording head has an orifice for forming flying droplets of a liquid by discharging the liquid. An energy generating member for generating energy is used for discharging the liquid, and a liquid passage communicates with the orifice. In addition, temperature detector is provided on the side of an inner surface of the liquid passage which is substantially opposed to the energy generating member.

24 Claims, 3 Drawing Sheets

LIQUID INJECTION RECORDING APPARATUS HAVING TEMPERATURE DETECTING MEANS IN A LIQUID PASSAGE

This application is a continuation of application Ser. No. 117,526, filed Nov. 6, 1987, now abandoned.

BACKGROUND OF THE INVENTION

1. Field of the Invention

The present invention relates to a liquid injection recording head which is used in a liquid injection recording method in which flying droplets of a liquid are formed by injecting the liquid, and recording is performed by using the droplets.

2. Related Background Art

In a liquid injection recording method, flying droplets of a liquid are formed by injecting the liquid from a fine discharge port, and recording is performed by causing the droplets to be reached and deposited on a recording member.

In this recording method, the temperature of the liquid is critically important, because the physical properties, e.g., surface tension and viscosity, change depending on the temperature. The amount of the liquid injected, the speed of supplying the liquid, and the like also vary due to that change. Accordingly, an arrangement is conventionally adopted such that problems will not occur due to a temperature change of the liquid resulting from a change in the temperature of the external environment and the like.

Hitherto, temperature control has in many cases been effected by heating. In order to effect better temperature control, the temperature control has been carried out by providing a recording head with a heating element and by detecting the temperature of the recording head. However, with the conventional method in which the temperature of the external surface of the recording head is detected, it is difficult to detect the temperature of the interior of the recording head speedily and accurately. Particularly in the case of a recording head of a multiorifice array type (full-line type), the temperature of the liquid in the entire recording head does not necessarily become uniform due to the accumulation of heat and the like generated by the apparatus, so that it cannot necessarily be said that optimum liquid-temperature control can be effected by temperature detection using one detection means.

Furthermore, in the case of the recording head of a full-line type, where the liquid injection recording method using thermal energy is used, there have been cases where, if the liquid is discharged continuously from all of the orifices, a temperature difference arises between the liquid in the vicinity of an end portion of the recording head and the liquid in the vicinity of a central portion thereof.

Such nonuniformity of the temperature leads to the nonuniformity of the diameter of droplets formed by discharging, the discharging speed, etc. In other words, with the conventional temperature control, it has been difficult to effect accurate liquid-temperature control. Moreover, as the length of the recording head increases as in the case of the full-line type, it becomes difficult to maintain uniformity in the temperature, with the result that a difference arises in the discharging characteristics of the liquid discharged from one recording head and, hence, in the quality of a recorded image. Therefore, it has been virtually impossible to obtain satisfactory results in meeting the demand for higher-quality recording.

SUMMARY OF THE INVENTION

Accordingly, an object of the present invention is to provide a liquid injection recording head and a liquid injection recording apparatus having said head, which are capable of making as uniformly as possible the temperature of a liquid which is contained in a recording head and is at least substantially involved in discharging.

Another object of the present invention is to provide a liquid injection recording head and a liquid injection recording apparatus having said head, which does not cause uneveness in density in a recording image and is capable of obtaining a recording image of higherquality.

To this end, according to one aspect of the invention, there is provided a liquid injection recording head having at least one orifice for forming flying droplets of a liquid by discharging the liquid, at least one energy generating member for generating energy used for discharging the liquid, and at least one liquid passage communicating with the orifice, the liquid injection recording head comprising: temperature detecting means provided on the side of an inner surface of the liquid passage which is substantially opposed to the energy generating member.

In other words, the present invention provides a liquid injection recording head and a liquid injection recording apparatus having the head, wherein the temperature detecting means is provided in the liquid passage communicating with the orifice, separately from the energy generating member for generating energy for discharging the liquid.

According to another aspect of the invention, there is provided a liquid injection recording head having a substrate provided with at least one energy generating member for generating energy used for discharging the liquid, a plate disposed to form at least one liquid passage formed in correspondence with the energy generating member, and at least one orifice for discharging the liquid communicating with the liquid passage, the liquid injection recording head comprising: temperature detecting means disposed in the plate in such a manner as to correspond to the liquid passage.

In accordance with a further aspect of the invention, there is provided a liquid injection recording apparatus comprising at least one orifice for forming flying droplets of a liquid by discharging the liquid, at least one energy generating member for generating energy used for discharging the liquid, a liquid injection recording head having at least one liquid passage communicating with the orifice, temperature detecting means for detecting the temperature of the liquid injection recording head, control means for controlling the temperature of the liquid injection recording head on the basis of information supplied from the temperature detecting means, heating means for heating the liquid injection recording head on the basis of the information supplied from the control means, and driving means for driving the energy generating member, wherein the temperature detecting means is disposed on the side of an inner surface of the-liquid passage which is substantially opposed to the energy generating member.

DETAILED DESCRIPTION OF THE PREFERRED EMBODIMENT

Referring now to the accompanying drawings, the present invention will be described.

Figure 3:
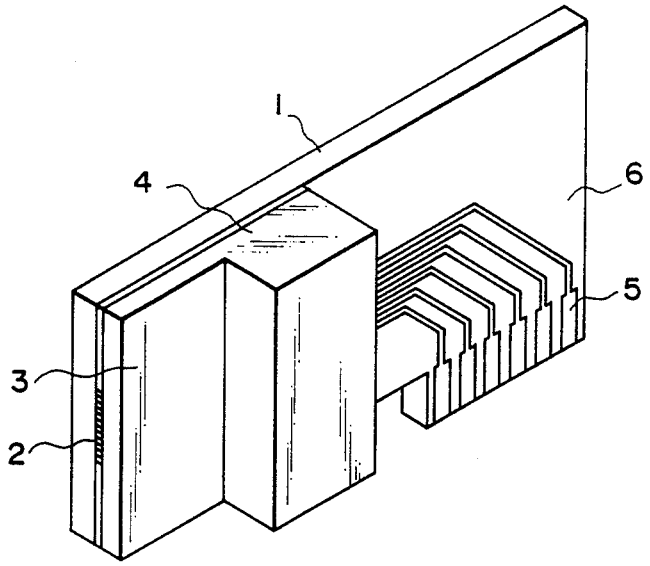
FIGS. 3 and 5 are schematic perspective views illustrating a preferred embodiment of a liquid injection recording head in accordance with the present invention.

FIG. 3 is a schematic perspective view illustrating a preferred embodiment of a liquid injection recording head in accordance with the present invention. In FIG. 3, reference numeral 1 denotes a substrate provided with an energy generating member; 2, a discharge port; 3, a plate; 4, a side wall; and 5, an electrode adapted to supply an electric signal to an energy generating means (not shown) and to output an electric signal supplied from temperature detecting means (not shown).

Figure 1:
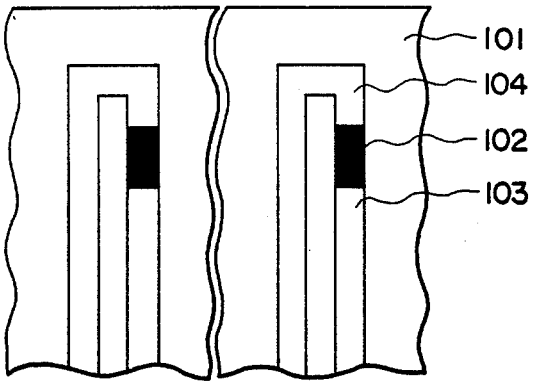
FIGS. 1 and 2 are a schematic partial plane view and a schematic cross-sectional partial view illustrating temperature detecting means in accordance with the present invention.
Figure 2:
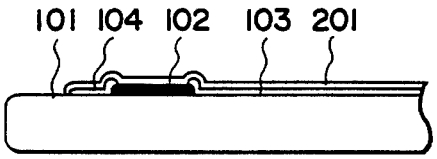

FIG. 1 is a schematic plan view of the plate 3 shown in FIG. 3, when viewed from the side of a liquid passage, while FIG. 2 is a schematic cross-sectional partial view thereof.

As shown in FIGS. 1 and 2, the temperature detecting means has a selective electrode 103 and a common electrode 104, which are a pair of electrodes electrically connected to a resistance layer 102 formed on a plate 101, as well as a protective layer 201 designed to insulate the pair of electrodes from the resistance layer 102 and/or to provide protection from corrosion or the like.

In the case of this embodiment, although the resistance layer 102 is formed in such a manner a to be located only between the electrodes, the resistance layer 102 may be provided on the entire lower surfaces of the electrodes. This is a design choice in the manufacturing process.

In addition, although the common electrode of the temperature detecting means is bent into a U-shape, as shown in FIG. 1, it goes without saying that this shape can be altered, as required, by taking into account factors such as ease in providing electrical conductors from the electrodes to an external portion of the head in view of the configuration and the like of the overall liquid injection recording head.

As for the plate 101 used in the present invention, most types of glass, metal, and plastics that are generally used as substrates can be used. However, it is preferable to use glass, in particular, because of the flatness of the material and the formation of the temperature detecting means.

A material which is capable of constituting the resistance layer 102 may be the material whose electrical resistance has temperature dependence within a desired temperature range. For instance, if a thin film thermistor is formed, semiconductor substances such as SiC, SnSe, TaN, and Ge can be cited as the material. The resistance layer 102 can be formed by a deposition process or a sputtering process using the aforementioned material.

The thickness of the resistance layer 102 is determined appropriately in view of various conditions, but is normally set to 0.001–5 μm, preferably 0.01–1 μm.

Any conventional electrode material which is capable of constituting the electrodes 103, 104, may be employed. For instance, metals such as Al, Ag, Au, Pt, and Cu can be used, and the electrodes 103, 104 can be formed by means of the deposition process or the like.

On the plate where a heat-generating resistance layer and the electrodes of predetermined configurations are thus provided, the protective layer is provided, as necessary, on the resistance layer and the electrodes below an area where the liquid flows or stagnates.

This protective layer's primary object is to chemically and physically protect the electrodes and the resistance layer from the liquid which comes into contact with the same and to prevent a short circuit between the electrodes occurring due to the liquid, leakage between electrodes of the same type, particularly between selective electrodes, and galvanic corrosion of electrodes occurring as a result of contact between an energized electrode with the liquid.

As for this protective layer, it is possible to use inorganic material, such as metal oxides, metal nitrides, and metal carbides, and organic material, such as resins. The protective layer is thus formed of a material which is selected appropriately in such a manner as to satisfy the characteristics required in accordance with a location of the protective layer.

During printing, the temperature of the liquid in a plurality of liquid passages is detected sequentially by the temperature detecting means thus formed. As for methods of detection, there is one in which a voltage is detected by causing a constant current to flow, and one in which a current is detected by applying a constant voltage.

Figure 4:
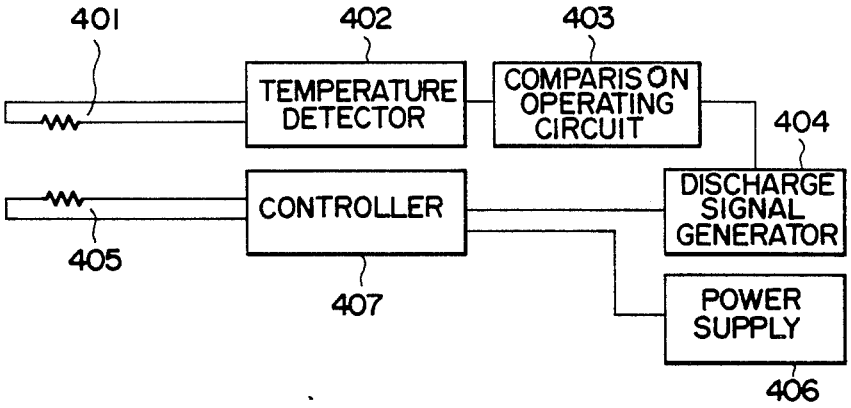
FIG. 4 is a block diagram illustrating an embodiment of temperature control using the recording head of the present invention.

Referring now to FIG. 4, a description will be given of the former case. A voltage detected by a temperature detector 402 is input to a comparison operating circuit 403, and is compared with a reference voltage set to a desired value (this value is determined by the characteristics and the, like of temperature detecting means 401). Since the resistance value of the temperature detecting means 401- becomes large at a temperature which is lower than a reference temperature corresponding to the set reference voltage, the detected voltage becomes greater than the reference voltage.

With respect to a liquid passage whose measured voltage is greater than the reference voltage, that liquid passage or a plurality of liquid passages adjacent thereto are preheated.

As for a method of preheating, if thermal energy is used as energy for discharging the liquid, a signal to be input to an electrothermal conversion member 405, which is the energy generating member, is controlled by a discharge signal generator 404 which is the temperature control means in this embodiment, and a DC bias current is made to flow to the conversion member 405 to such a degree that the liquid will not be discharged, via a controller 407 which is driving means for driving the energy generating member (i.e., an electrothermal conversion element in this embodiment) connected to a power supply 406.

In addition, there are methods such as one in which a short pulse voltage is applied to such a degree that the liquid will not be discharged, and one in which a pulse width of a discharging and driving signal is increased.

It goes without saying that the temperature control may be effected by means of a heating control means for heating a heater provided especially for heating, on the basis of information on the temperature supplied from the temperature detecting means.

If discharge is performed using thermal energy as in the case of this embodiment the electrothermal conversion member for generating that thermal energy can be used directly as an element for heating the fluid and the temperature may be controlled accurately in each fluid passage even in a case where a full-line system is adopted.

Figure 5:
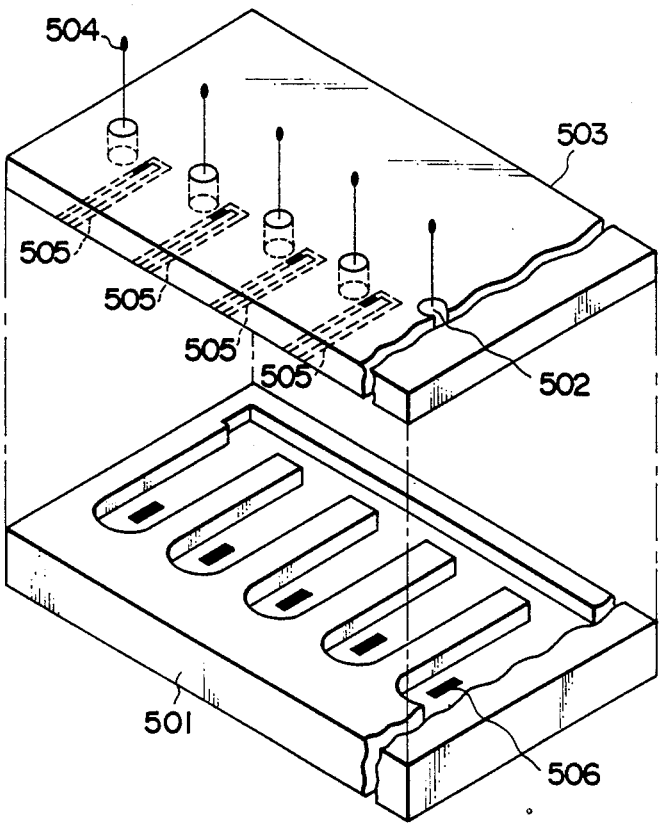

Furthermore, it goes without saying that the present invention can be applied not only to the recording head having a form as shown in FIG. 3, but also to that having a form as shown in FIG. 5, i.e., a case where the direction of influx of the liquid into the passage and the discharging direction of the liquid do not coincide, but are bent with respect to each other.

In FIG. 5, reference numeral 501 denotes a substrate having an energy generating member 506; 502, a discharge port for discharging the liquid; and 503, a plate (orifice plate) having the discharge port 502. In addition, reference numeral 504 schematically illustrates a liquid being discharged from the discharge port 502. The orifice plate 503 is provided with a temperature detecting means 505, such as the one described above, in such a manner as to correspond to each discharge port 502.

It goes without saying that the configuration of blocks for effecting the temperature control, as described in FIG. 4, can be adopted in this embodiment as well.

In addition, it is possible to detect the temperature for each of the temperature detecting means in this embodiment as well, and the temperature of the overall recording head can be made uniform within a desired temperature range on the basis of the detected result.

Thus, according to the liquid injection recording head obtained in the present invention, it is possible to measure the temperature of the recording liquid in each of the liquid passages, and to conduct a detailed analysis of the temperature distribution for each of the liquid passages.

Furthermore, it is also possible to obtain a substantially uniform temperature distribution by preheating heating resistors in the liquid passage having a relatively low temperature, while the temperature of the liquid passages are measured sequentially. As a result, a high-quality image which is free of unevenness was obtained.

Since the temperature detecting means are provided on the plate side, no problem is presented in ensuring a high degree of integration, and no adverse effect is exerted on the substrate manufacturing process.

Figure 6:
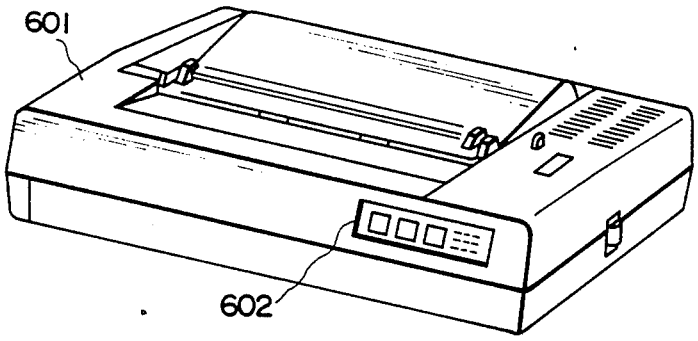
FIG. 6 is a schematic perspective view of an apparatus of the present invention.

FIG. 6 shows a schematic perspective view of an apparatus having the liquid injection recording head (not shown) in accordance with the present invention.

In FIG. 6, reference numeral 601 denotes an apparatus body cover, while numeral 602 denotes an operation panel on which switches and/or a display that are connected to various control mechanisms for controlling the apparatus are provided.

The liquid injection recording head of the present invention is covered with the apparatus body cover 601. A recording member is disposed in such a manner as to oppose the discharge ports of the recording head, in the same way as the generally known recording apparatuses.

The recording head of the present invention disposed in such a recording apparatus is capable of performing a high-quality recording with high accuracy even if recording operations are carried out for extended periods of time.

I claim:

1. A liquid injection recording head comprising:

a plurality of liquid passages each in communication with a corresponding orifice for discharging liquid, a plurality of energy generating members on a substrate, each said energy generating member corresponding to one of said liquid passages for generating energy used to discharge the liquid through said corresponding orifice, a plurality of temperature detecting elements on a cover plate secured to said substrate to form said liquid passages, each said temperature detecting element being disposed on an inner surface of one of said liquid passages substantially opposed to said corresponding energy generating member for individually detecting the temperature of the liquid in each said liquid passage, and heating means for individually heating the liquid in each said liquid passage in accordance with the temperature of the liquid detected by said corresponding temperature detecting element.

2. A liquid injection recording head according to claim 1, wherein each said temperature detecting element comprises a thermistor.

3. A liquid injection recording head according to claim 1, wherein each said temperature detecting element includes a combination of a resistance layer having temperature dependence and an electrode connected electrically to said resistance layer.

4. A liquid injection recording head according to claim 3, wherein said resistance layer comprises a material selected from at least one of SiC, SnSe, TaN, and Ge.

5. A liquid injection recording head according to claim 3, wherein each said temperature detecting element has a protective layer provided on said resistance layer and/or said electrode.

6. A liquid injection recording head according to claim 1, wherein said energy generating member is an electrothermal energy conversion member.

7. A liquid injection recording head according to claim 1, wherein said energy generating members generate heat to form bubbles in said liquid passages to discharge liquid through said orifices and said heating means include said energy generating members.

8. A liquid injection recording head comprising:

a substrate, a plate secured to said substrate to provide a plurality of liquid passages each in communication with a corresponding orifice for discharging liquid, a plurality of energy generating members on said substrate, each said energy member corresponding to one of said liquid passages for generating energy used to discharge the liquid through said corresponding orifice, a plurality of temperature detecting elements on said plate, each said temperature detecting element being disposed on an inner surface of one of said liquid passages substantially opposed to said corresponding energy generating member for individually detecting the temperature of the liquid in each said liquid passage, and heating means, responsive to control means, for individually heating the liquid in each said liquid passage in accordance with the temperature of the liquid detected by said corresponding temperature detecting element.

9. A liquid injection recording head according to claim 8, wherein each said orifice is provided at a terminating end of each said liquid passage.

10. A liquid injection recording head according to claim 8, wherein each said orifice is disposed in such a manner that the discharging direction of the liquid differs from the directing of influx of the liquid into said corresponding liquid passage.

11. A liquid injection recording head according to claim 8, wherein each said temperature detecting element comprises a thermistor.

12. A liquid injection recording head according to claim 8, wherein each said temperature detecting element includes a combination of a resistance layer having temperature dependence and an electrode connected electrically to said resistance layer.

13. A liquid injection recording head according to claim 12, wherein said resistance layer comprises a material selected from at least one of SiC, SnSe, TaN, and Ge.

14. A liquid injection recording head according to claim 12, wherein each said temperature detecting element has a protective layer provided on said resistance layer and/or said electrode.

15. A liquid injection recording head according to claim 8, wherein said energy generating member is an electrothermal energy conversion member.

16. A liquid injection recording head according to claim 8, wherein said energy generating members generate heat to form bubbles in said liquid passages to discharge liquid through said orifices and said heating means include said energy generating members.

17. A liquid injection recording apparatus comprising:

a liquid injection recording head including a plurality of liquid passages each in communication with a corresponding orifice for discharging liquid, a plurality of energy generating members on a substrate, each said energy generating member corresponding to one of said liquid passages for generating energy used to discharge the liquid through said corresponding orifice, and a plurality of temperature detecting elements on a cover plate secured to said substrate to form said liquid passages, each said temperature detecting element being disposed on an inner surface of one of said liquid passages substantially opposed to said corresponding energy generating member for individually detecting the temperature of the liquid in each said liquid passage, heating means for individually heating the liquid in each said liquid passage, and control means for controlling said heating means to individually heat the liquid in each said liquid passage on the basis of the information supplied from said temperature detecting elements.

18. A liquid injection recording apparatus according to claim 17, wherein said energy generating members generate heat to form bubbles in said liquid passages to discharge liquid through said orifices and said heating means include said energy generating members.

19. A liquid injection recording apparatus according to claim 17, further comprising driving means for individually driving said energy generating members, wherein joint use is made of said control means and said driving means.

20. A liquid injection recording head according to claim 17, wherein each temperature detecting element comprises a thermistor.

21. A liquid injection recording head according to claim 17, wherein each said temperature detecting element includes a combination of a resistance layer having temperature dependence and an electrode connected electrically to said resistance layer.

22. An liquid injection recording head according to claim 21, wherein said resistance layer comprises a material selected from at least one of SiC, SnSe, TaN, and Ge.

23. A liquid injection recording head according to claim 21, wherein each said temperature detecting element has a protective layer provided on said resistance layer and/or said electrode.

24. A liquid injection recording head according to claim 17, wherein said energy generating member is an electrothermal energy conversion member.

* * * * *

UNITED STATES PATENT AND TRADEMARK OFFICE

CERTIFICATE OF CORRECTION

PATENT NO. : 4,947,194

DATED : August 7, 1990

INVENTOR(S) : MASAYUKI KYOSHIMA

It is certified that error appears in the above-identified patent and that said Letters Patent is hereby corrected as shown below:

COLUMN 1

Line 20, "to be reached and deposited" should read --to reach and be deposited--.
Line 50, "the" should read --a--.

COLUMN 2

Line 15, "uneveness" should read --unevenness-.
Line 16, "higherquality." should read --higher quality.--.
Line 63, "the-liquid" should read --the liquid--.

COLUMN 3

Line 38, "manner a" should read --manner as--.

COLUMN 4

Line 25, "a" should read --the--.
Line 39, "the," should read --the--.
Line 40, "resistance value" should read --resistance--.
Line 41, "means 401-" should read --means 401--.

COLUMN 5

Line 47, "was" should read --is--.

COLUMN 6

Line 55, "energy member" should read --energy generating member--.

UNITED STATES PATENT AND TRADEMARK OFFICE

CERTIFICATE OF CORRECTION

PATENT NO. : 4,947,194

DATED : August 7, 1990

INVENTOR(S) : MASAYUKI KYOSHIMA

It is certified that error appears in the above-identified patent and that said Letters Patent is hereby corrected as shown below:

COLUMN 7

Line 8, "directing" should read --direction--.

COLUMN 8

Line 26, "temperature detecting element"should read --said temperature detecting element--.

Signed and Sealed this

Twenty-eighth Day of April, 1992

*Attest:*

HARRY F. MANBECK, JR.

*Attesting Officer*

*Commissioner of Patents and Trademarks*